US007534289B1

(12) United States Patent
Yomogida

(10) Patent No.: US 7,534,289 B1
(45) Date of Patent: May 19, 2009

(54) ELECTROLESS GOLD PLATING SOLUTION

(75) Inventor: Koichi Yomogida, Saitama (JP)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 12/217,241

(22) Filed: Jul. 2, 2008

(51) Int. Cl.
*C23C 18/31* (2006.01)

(52) U.S. Cl. ..... 106/1.23; 106/1.26

(58) Field of Classification Search ..... 106/1.23, 106/1.26
See application file for complete search history.

(56) References Cited

U.S. PATENT DOCUMENTS

| | | | | |
|---|---|---|---|---|
| 3,769,183 | A * | 10/1973 | Adelman | 205/307 |
| 4,591,415 | A * | 5/1986 | Whitlaw | 205/125 |
| 4,687,557 | A | 8/1987 | Emmenegger | 205/50 |
| 4,820,388 | A * | 4/1989 | Kurze et al. | 205/239 |
| 5,169,514 | A * | 12/1992 | Hendriks et al. | 205/247 |
| 5,803,957 | A * | 9/1998 | Murakami et al. | 106/1.26 |
| 6,287,371 | B1 * | 9/2001 | Ota et al. | 106/1.26 |
| 6,736,886 | B2 * | 5/2004 | Suda et al. | 106/1.23 |
| 6,991,675 | B2 * | 1/2006 | Suda et al. | 106/1.23 |

FOREIGN PATENT DOCUMENTS

| | | |
|---|---|---|
| EP | 1 273 678 | 1/2003 |
| JP | 2005307309 | 11/2005 |
| JP | 2008214703 | 9/2008 |
| WO | WO 00/28108 | 5/2000 |

OTHER PUBLICATIONS

European Search Report of corresponding European Patent Application No. 08 16 0251 mailed Dec. 19, 2008.

* cited by examiner

*Primary Examiner*—Helene Klemanski
(74) *Attorney, Agent, or Firm*—John J. Piskorski

(57) ABSTRACT

An electroless gold plating solution that can form a gold plating film with excellent adhesion and that does not cause corrosion of a base metal film such as nickel, copper, cobalt, or palladium, or the like.

9 Claims, No Drawings

ELECTROLESS GOLD PLATING SOLUTION

The present invention relates to an electroless gold plating solution. Furthermore, the present invention relates to an electroless gold plating solution which can be used to deposit gold on the surface of a metal such as nickel or copper.

Conventionally, gold plating is used as a final surface treatment for electronic industrial components such as printed circuit boards, ceramic IC packages, ITO boards, and IC cards, and the like, from the standpoint of electrical conductance of gold, solderability, physical characteristics such as connectivity by thermal crimping, and oxidation resistance. Use of electroless plating rather than electroplating is preferable for most of these electronic industrial components because of the need to perform gold plating on electrically independent components and components with complex shapes.

A printed circuit board normally has electroless nickel plating on the surface of a base metal such as copper wiring, and often electroless gold plating is performed on the surface of the nickel. For this case, substitution gold plating solutions which deposit gold while dissolving the base metal such as nickel, and self-catalyzing electroless gold plating solutions which deposit gold by the effects of a reducing agent which has catalytic activity towards gold, are widely known. Substitution gold plating deposits gold by a substitution reaction between gold and the base metal, and even when self-catalyzing electroless gold plating is used, a substitution gold plating reaction is used when initiating the self catalyzing electroless gold plating reaction. In other words, immediately after the self-catalyzing electroless gold plating solution and the plating subject come in contact, deposition of gold begins because of a substitution reaction between the base metal and the gold. The substitution reaction in electroless gold plating uses the dissolution of the base metal as a driving force for depositing the gold. This substitution reaction is affected by the structure of the base metal such as the crystalline grain boundary, and the like, so there are differences in the level of dissolution of the base metal. In regions where the metal is materially weaker such as at the crystalline grain boundaries, or the like, of the base metal, the substitution reaction proceeds preferentially compared to other regions, and in other words, inconsistencies occur in the dissolution of the base metal. Corrosion of the base metal, beginning with the non-uniform dissolution of the base metal, causes problems such as local embrittlement of the base metal adhesion of the gold plating film obtained is degraded, and lower solder bonding strength.

Substitution gold plating solutions with a cyan group further containing ammonium chloride in order to control the localized corrosion of the base metal (for example, see Japanese unexamined patent application S59-6365), or further containing a nitrogen-containing compound as a gold deposition controlling agent (for example, see Japanese unexamined patent application 2000-144441), or further containing polyethyleneimine (for example, Japanese unexamined patent application 2003-13248) have been proposed. However, these electroless gold plating solutions have been able to reduce the corrosion of the nickel film, which is the base metal layer, to some degree, but there are problems with a reduction in the deposition speed of the gold plating film because the dissolution speed of the nickel film is decreased.

An object of the present invention is to resolve the aforementioned problems, and to provide an electroless gold plating solution that can uniformly plate and can increase the adhesion to the base metal without corroding the base metal.

As result of diligent investigations to resolve the aforementioned problems, the present inventors have discovered that the aforementioned objective can be achieved by using an electroless gold plating solution that comprises a combination of specific components, and have thus achieved the present invention. In other words, the present invention is an electroless gold plating solution that is used to perform metal plating on the surface of a metal, comprising:

(i) a water soluble gold cyanide compound;

(ii) a complexing agent; and (iii) a pyridinium carboxylate compound having a phenyl group or an aralkyl group in the first position.

Furthermore, the present invention provides an electroless gold plating solution further containing (iv) at least one compound selected from formic acid and salt thereof as well as hydrazine and derivative thereof, as a base metal surface treatment agent.

Furthermore, the present invention provides an electroless gold plating solution that is used to perform gold plating on the surface of a metal, comprising:

(i) a water soluble gold cyanide compound;

(ii) a complexing agent with at least one type selected from ethylenediaminetetramethylene phosphonic acid or derivative thereof;

(iii) at least one compound selected from a pyridinium carboxylate compound having a phenyl group or an aralkyl group in the first position;

(iv) at least one compound selected from hydrazine and derivative thereof, as a base metal surface treatment agent; and (v) at least one compound selected from polycarboxylic acid and salts thereof.

By using the electroless gold plating solution of the present invention, undesired dissolving, or in other words corrosion, of the base metal can be suppressed, adhesion can be increased, a uniform gold plating film can be formed, and the deposition rate of the gold can be increased.

Furthermore, the electroless gold plating solution of the present invention can deposit a favorable gold film with good appearance and solder bonding strength without causing localized corrosion of the base metal such as nickel.

The present invention will be described below in detail. The electroless gold plating solution of the present invention is an aqueous solution containing a water soluble gold cyanide compound, a complexing agent, a pyridinium carboxylate compound having a phenyl group or a aralkyl group at the first position, and optionally containing a polycarboxylate, and at least one type of base metal surface treatment agent, such as formic acid or salt thereof, or a hydrazine or derivative thereof.

The water soluble gold cyanide compound used with the present invention can be any gold cyanide compound without restrictions in particular so long as the gold cyanide compound is water soluble, can provide gold ions to the plating solution, and is conventionally used in gold plating solutions. Examples of this type of water soluble gold cyanide compound include potassium dicyanoaurate (I) and potassium tetracyanoaurate (III). The water soluble gold cyanide compound may be a single type, or two or more types may be blended and used.

The electroless gold plating solution of the present invention suitably contains these water soluble gold cyanide compounds with a gold ion concentration of between 0.1 and 10 g/L, for example, and preferably between 0.5 and 5 g/L.

The complexing agent used with the present invention can be any substance used in publicly known gold plating solutions so long as the substance is water soluble, can stably maintain the gold ion in the plating solution, and a plating bath containing this complexing agent will essentially not dissolve nickel, cobalt, or palladium. Examples of these complexing agents include organic phosphonic acids or salts thereof which have a plurality of phosphonic acid groups or salts thereof in a molecule, and aminocarboxylic acid or salt thereof, and the like. Phosphonic acids or salts thereof preferably have a group with the structure shown below for example.

—PO3MM' wherein M and M' may be either the same or different, and is selected from a group consisting of hydrogen atom, sodium, potassium, and ammonium. The number of phosphoric acid groups or salts thereof in the compound is between 2 and 6, preferably between 2 and 5.

The organic phosphonic acid used with the present invention preferably is a compound with the following construction.

Formula 1:

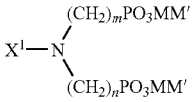

(1)

wherein $X^1$ is a hydrogen atom, a $C_1$ through $C_5$ alkyl group, an aryl group, an arylalkyl group, an amino group, or a $C_1$ through $C_5$ alkyl group substituted with —OH, —COOM, or $PO_3MM'$. M and M' are as defined above. Furthermore, m and n are integers and are either 0 or 1.

Herein, the term "alkyl group" includes those with a straight chain or a branched chain. A "$C_1$ through $C_5$ alkyl" refers to an alkyl group with between 1 and 5 carbon atoms. An example of a $C_1$ through $C_5$ alkyl group is a methyl group, ethyl group, propyl group, isopropyl group, butyl group, isobutyl group, sec-butyl group, tert-butyl group, or pentyl group, or the like. An example of an aryl group is a phenyl group or a naphthyl group or the like. An example of an arylalkyl group is one of the aforementioned alkyl groups with the aforementioned aryl groups as a substitution group. An example of an amino group is an amino group that has hydrogen atoms, and the aforementioned alkyl groups, or the like, on a nitrogen atom.

Formula 2:

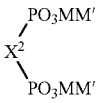

wherein $X^2$ is, for example, —$CH_2$—, —CH(OH)—, —$C(CH_3)$(OH)—, —$CH(PO_3MM')$—, —$C(CH_3)(PO_3MM')$—, —CH(CH(COOM)— or —$C(CH_3)$(COOM)—, or the like, and M and M' are as defined above.

Formula 3:

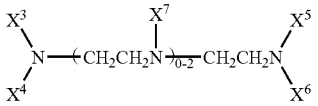

wherein $X^3$ through $X^7$ are similar to the aforementioned $X^1$. However, at least two of $X^3$ through $X^7$ are —PO3MM'.

Examples of the aforementioned organic phosphonic acid include aminotrimethylene phosphonic acid, 1-hydroxyethylidene-1,1-diphosphonic acid, ethylenediaminetetramethylene phosphonic acid, diethylenetriamine pentamethylene phosphonic acid, as well as the sodium salt, potassium salt, or ammonium salt, or the like, thereof. The complexing agent used in the present invention may be a single type, or maybe a blend of two or more types.

Examples of the aminocarboxylate include glycerin, imino diacetate, hydroxyethylethylenediamine triacetate, tetrahydroxyethylenediamine, dihydroxymethylethylenediamine diacetate, ethylenediamine tetraacetate, ethylenediaminetetrapropionic acid as well as sodium salts, potassium salts, and ammonium salts thereof.

Examples of the aforementioned ethylenediamine derivative having a phosphoric acid group or salt thereof or an aminocarboxylate group or salt thereof, included ethylenediaminetetramethylene phosphonic acid, hydroxyethylethylenediamine triacetate, tetrahydroxyethylenediamine, hydroxymethylethylenediamine diacetate, ethylenediamine tetraacetate, but ethylenediaminetetrapropionic acid, as well as sodium, potassium, and ammonium salts thereof, are preferably used as complexing agents with the present invention.

The complexing agent used in the present invention is preferably used in a range between 0.005 and 0.8 mol/L, more preferably between 0.02 and 0.6 mol/L. The number of moles of complexing agent contained is preferably equivalent to or higher than the number of moles of gold ion present in the plating solution.

The electroless gold plating solution of the present invention contains a pyridinium carboxylate compound with a phenyl group or an aralkyl group at the first position. These pyridinium carboxylate compounds with a phenyl group or an aralkyl group at the first position cause a uniform gold plating film to be deposited with fine deposition particles of gold that adhere to the base metal surface that is the surface of the plating subject, and suppresses the elution of the base metal by the action of suppressing the substitution reaction between the gold ions and the base metal in the electroless gold plating solution, while increasing the gold deposition rate.

Examples of the pyridinium carboxylate compound with a phenyl group or an aralkyl group at the first position include 1-phenyl-pyridinium-2-carboxylic acid, 1-phenyl-pyridinium-3-carboxylic acid, and 1-phenyl-pyridinium-4-carboxylic acid, as well as 1-phenylalkylene-pyridinium carboxylate compounds such as 1-benzyl-pyridinium-2-carboxylic acid, 1-benzyl-pyridinium-3-carboxylic acid, 1-benzyl-pyridinium-4-carboxylic acid, 1-(phenylether)-pyridinium-2-carboxylic acid, 1-(phenylethyl)-pyridinium-3-carboxylic acid, 1-(phenylether)-pyridinium-4-carboxylic acid, 1-(phenylether)-pyridinium-4-carboxylic acid, 1-(phenylpropyl)-pyridinium-2-carboxylic acid, 1-(phenylpropyl)-pyridinium-3-carboxylic acid, 1-(phenylpropyl)-pyridinium-4-carboxylic acid, 1-(phenylbutyl)-pyridinium-2-carboxylic acid, 1-(phenylbutyl)-pyridinium-3-carboxylic acid, 1-(phenylbutyl)-pyridinium-4-carboxylic acid, 1-(phenylpentyl)-pyridinium-2-carboxylic acid, 1-(phenylpentyl)-pyridinium-3-carboxylic acid, 1-(phenylpentyl)-pyridinium-4-carboxylic acid, as well as sodium salt, potassium salts, or ammonium salt of these carboxylic acids, as well as hydroxides, chlorides, and bromides of these compounds and the like. One of the preferable compounds of the pyridinium carboxylate compounds having a phenyl group or an aralkyl group at the first position is 1-benzyl-pyridinium-3-carboxylic acid or carboxylate thereof. These compounds may be used independently, or two or more types may be blended and used together.

The pyridinium carboxylate compound having a phenyl group or an aralkyl group at the first position used with the present invention is used in a range between 0.1 and 100 g/L, preferably in a range between 5 and 30 g/L.

The electroless gold plating solution of the present invention also preferably comprises a base metal surface treatment agent. The base metal surface treatment agent used with the present invention is a substance which has the effect of reducing a metal that is in the oxidized state which is formed on the surface of a base metal selected from a group consisting of nickel, copper, cobalt, palladium, as well as alloys comprising these metals. These substances act as a reducing agent and preferentially oxidize the base metal over the gold ion, and when combined with a pyridinium carboxylate compound which has a phenyl group or an arakyl group at the first position, corrosion of the base metal is suppressed, adhesion is increased, a uniform gold plating film is formed, and the gold deposition rate is increased.

Examples of the base metal surface treatment agent include formic acid and salts thereof, such as formic acid, sodium formate, potassium formate, ammonium formate; and hydrazine and derivatives thereof such as a hydrazine, hydrazine hydrate, as well as hydrazine sulfate, hydrazine chloride, and salts thereof. The base metal surface treatment agent used with the present invention may be used individually, or two or more types may be blended and used together.

The base metal surface treatment agent used with the present invention is used in a range between 0.1 and 20 g/L, preferably in a range between 1 and 15 g/L.

The electroless gold plating solution of the present invention preferably also comprises a polycarboxylic acid or salt thereof. The polycarboxylic acid or salt thereof suppresses pinhole-type corrosion by adhering to the surface of the base metal, and stabilizes the plating solution by forming a salt that complexes with the base metal ions which have eluted into the plating solution. Examples of this polycarboxylic acid or salt thereof include oxalic acid, maleic acid, fumaric acid, malic acid, citric acid, adipic acid, as well as the sodium salt, potassium salts, or ammonium salt thereof, and the like. Citric acid or tripotassium citrate are preferable. The polycarboxylic acid or salt thereof may be used individually, or two or more types may be blended and used together.

The polycarboxylic acid or salt thereof used with the present invention is present in a range, for example, between 0 and 100 g/L, preferably in a range between 30 and 75 g/L.

The pH of the electroless gold plating solution of the present invention is preferably between 3 and 8, and more preferably between 5 and less than 7. The pH of the gold plating solution of the present invention is adjusted using, for instance, sodium hydroxide, potassium hydroxide, ammonium hydroxide, sulfuric acid, sulfurous acid, HCl, phosphoric acid, cyanic acid, sulfamic acid, organic sulfonic acid, a phosphonic acid, or carboxylic acid, or the like. Furthermore, if necessary a pH stabilizer may also be provided. Examples of pH stabilizers include phosphates, phosphites, borates, carbonates, and cyanates, and the like.

If necessary, the electroless gold plating solution of the present invention may comprise a wetting agent in order to increase the wetness of the base metal that is the coating subject. The wetting agent can be used without restriction in particular so long as the wetting agent is a substance which has been conventionally used in gold plating solutions. Examples of the wetting agent include nonionic surfactants such as polyoxyalkylene alkyl ether, polyoxyalkylene alkylphenyl ether, polyoxyethylene polyoxy propylene glycol, fatty acid polyalkylene glycol, fatty acid polyalkylene sorbitans, and fatty acid alkanolamides; anionic surfactants such as fatty acid carboxylates, alkanesulfonates, alkylbenzene sulfonates; and cationic surfactants such as alkylamines, and the like.

If necessary, the electroless gold plating solution of the present invention can also contain a glossing agent in order to further increase the gloss off the gold plating film and then to make the gold plating film particles more compact. The glossing agent can be used without restrictions in particular, so long as the glossing agent is a substance which has conventionally been used in gold plating solutions. Examples of the glossing agent include thallium, arsenic, lead, copper, antimony, and the like. The electroless gold plating solution of the present invention can contain other compounds than the aforementioned, to the degree that a negative effect is not had on the properties of the plating solution.

When performing the gold plating using the electroless gold plating solution of the present invention, the process can be the same as a normal electroless plating method. Generally, the plating subject is immersed in the electroless gold plating solution, and the electroless gold plating film can be formed on the surface of the base metal made of nickel, cobalt, copper, palladium, or alloys containing these metals, by maintaining the temperature of the plating solution within a prescribed range. For instance, the gold plating solution of the present invention can be suitably used as an electroless gold plating solution in order to deposit gold on the surface of a metal such as nickel or copper.

When performing gold plating using the electroless gold plating solution of the present invention, the temperature (liquid temperature) of the gold plating solution is between 50° C. and 100° C., preferably between 70° C. and 95° C. The plating time is normally between 1 and 60 minutes, and preferably is between 10 and 30 minutes. When performing gold plating using the electroless gold plating solution of the present invention, the plating solution can be mixed, exchange filtered, or reflux filtered, but reflux filtering of the plating solution using a filter is particularly preferable.

The electroless gold plating solution of the present invention has good stability, and can form a uniform gold plating film with good appearance at an increased gold deposition rate that has excellent adhesion to the base metal. Furthermore, the electroless gold plating solution of the present invention has excellent properties for minimizing grain boundary corrosion and pinhole corrosion of nickel plating when nickel is the base metal.

Embodiments of the present invention will be presented below, but the present invention is not restricted to these embodiments.

EXAMPLES 1-22

For a test piece, an electroless nickel plating film with a thickness of approximately 5 μm was formed on a 5 cm×10 cm patterned copper clad laminate using a commonly known electroless nickel plating solution (Ronamax (trademark) SMT-115 at electroless nickel plating solution, product of Rohm & Haas Electronic Materials Co. Ltd.).

An electroless gold plating solution was prepared as an aqueous solution wherein water was added to 1.5 g/L of potassium dicyanoaurate, 50 mg/L of potassium cyanide, 150 g/L of ethylenediaminetetramethylene phosphonic acid, 10 g/L of potassium formate, 94.3 g/L of potassium hydroxide, and 0.5 g/L of a 48% aqueous solution of a chloride of sodium 1-benzylpyridinium-3-carboxylate. This electroless gold plating solution was adjusted to a pH of 5.3 by adding additional potassium hydroxide.

The aforementioned test piece was immersed for 10 minutes in the electroless gold plating solution at a liquid temperature of 90° C. to form a gold plating film. The film thickness of the gold plating film that was formed was measured using a fluorescent x-ray thickness meter, and the gold plating deposition rate was calculated. Furthermore, the color and the occurrence of a lack of deposition was evaluated by visually observing the gold plating film that was formed. The results are shown in Table 1.

The gold plating film that was formed was peeled using a gold plating stripping solution Enstrip AU-78M (product of Meltex Inc.), and the occurrence of corrosion on the surface of the nickel which was the base metal was observed using a FE-SEM JSM-7000F (product of JEOL Ltd.). The observation results are shown in Table 1 where 1=good, 2=fairly good (minimal corrosion), 3=partially corroded, 4=fairly heavily corroded, and 5=heavy corrosion.

Electroless gold plating solutions were prepared similarly to Embodiment 1 with the exception that the compounds shown in the following Table 1 were used in the amounts shown in the table in place of the aqueous solution containing a chloride of sodium 1-benzyl-pyridinium-3-carboxylate, electroless gold plating was performed, and the coating was observed. The results are shown in Table 1.

TABLE 1

| | Compound | Amount g/L | Deposition Rate μm/10 minutes | Gold Plating Film Appearance | Nickel Plating Film Corrosion |
|---|---|---|---|---|---|
| Embodiment 1 | 48% aqueous solution of a chloride of sodium 1-benzyl-pyridinium-3-carboxylate (g/L) | 0.5 | 0.092 | Good | 2 |
| Comparative Example 1 | Reaction product of imidazole and epichlorohydrin | 0.5 | 0.029 | Good | 3 |
| Comparative Example 2 | Sulfopropylpolyethyleneimine | 0.5 | 0.041 | Good | 2 |
| Comparative Example 3 | Reaction product of morpholine and epichlorohydrin | 0.5 | 0.036 | Good | 3 |
| Comparative Example 4 | Dimethylaminoethylmethacrylate quaternary compound | 0.5 | 0.029 | Good | 3 |
| Comparative Example 5 | Reaction product of dimethylamine, ammonia, and epichlorohydrin | 0.5 | 0.026 | Good | 3 |
| Comparative Example 6 | Polyethyleneimine (weighted average molecular weight 1300) | 0.5 | 0.010 | Good | 1 |
| Comparative Example 7 | Polyethyleneimine (weighted average molecular weight 2000) | 0.5 | 0.012 | Good | 1 |
| Embodiment 2 | 48% aqueous solution of a chloride of 1-benzyl-pyridinium-3-carboxylate (g/L) | 1.0 | 0.090 | Good | 2 |
| Embodiment 3 | 48% aqueous solution of a chloride of 1-benzyl-pyridinium-3-carboxylate (g/L) | 5.0 | 0.071 | Good | 2 |
| Comparative Example 8 | Polyvinylpyrrolidone (weighted average molecular weight 5000) | 0.5 | 0.066 | Good | 3 |
| Comparative Example 9 | Picoric acid | 5.0 | 0.120 | Good | 4 |
| Comparative Example 10 | Isonicotinic acid | 5.0 | 0.109 | Good | 4 |
| Comparative Example 11 | 3-picorinamine | 5.0 | 0.111 | Good | 5 |
| Comparative Example 12 | 4-phenylpropyl-pyridine | N.A. | N.A. | N.A. | N.A. |

The gold plating solution containing 4-phenylpropyl-pyridine which was used as Comparative Example 12 separated as oil, and gold plating was not possible.

As shown in Table 1, when the plating solutions of Embodiments 1 through 3 containing 1-benzyl-pyridinium-3-carboxylic acid were used, corrosion of the nickel plating which is the base metal was suppressed, and the gold plating deposition rate was clearly increased.

The aqueous solutions shown in Table 2 and 3 were prepared as electroless gold plating solutions. The pH of each of the electroless gold plating solutions was adjusted by adding additional potassium hydroxide. Similar to Embodiment 1, a test piece was immersed in the electroless gold plating solution, and the appearance of the gold plating film that was obtained and the occurrence of corrosion of the nickel plating film was evaluated. The results are shown in Table 2 and Table 3.

TABLE 2

| | Embodiments | | | | | | | | | | | | Comparison Examples | |
|---|---|---|---|---|---|---|---|---|---|---|---|---|---|---|
| | 4 | 5 | 6 | 7 | 8 | 9 | 10 | 11 | 12 | 13 | 14 | 15 | 13 | 14 |
| Potassium dicyanoaurate (I) (g/L) | 1.5 | 1.5 | 1.5 | 1.5 | 1.5 | 1.5 | 1.5 | 1.5 | 1.5 | 1.5 | 1.5 | 1.5 | 1.5 | 1.5 |
| Potassium cyanide (mg/L) | 50 | 50 | 50 | 50 | 50 | 50 | 50 | 50 | 50 | 50 | 50 | 50 | 50 | 50 |
| Ethylenediaminetetramethylene phosphonic acid (g/L) | 150 | 150 | 150 | 150 | 150 | 150 | 150 | 150 | 150 | 150 | 150 | 150 | 150 | 150 |
| Potassium hydroxide (g/L) | 94.3 | 94.3 | 94.3 | 94.3 | 94.3 | 94.3 | 94.3 | 94.3 | 94.3 | 94.3 | 94.3 | 94.3 | 94.3 | 94.3 |
| Potassium formate (g/L) | 10 | 10 | 10 | 10 | 10 | 10 | 10 | 10 | 10 | 10 | 10 | 10 | 10 | 10 |
| 48% aqueous solution of a chloride of sodium 1-benzyl-pyridinium-3-carboxylate (g/L) | 5 | 5 | 10 | 10 | 10 | 20 | 20 | 20 | 30 | 30 | 50 | 50 | | |
| pH | 5.0 | 6.0 | 5.0 | 6.0 | 7.0 | 6.0 | 6.5 | 7.0 | 6.5 | 7.0 | 6.5 | 7.0 | 5.3 | 6.0 |
| Gold deposition rate (μm/10 minutes) | 0.084 | 0.090 | 0.069 | 0.089 | 0.100 | 0.061 | 0.061 | 0.079 | 0.064 | 0.075 | 0.055 | 0.061 | 0.111 | 0.104 |
| Appearance of gold plating film | Good | Good | Good | Good | Good | Good | Good | Good | Good | Good | Good | Good | Good | Good |
| Corrosion of nickel plating film | 2 | 2 | 2 | 2 | 2-3 | 2 | 2 | 2-3 | 2 | 2-3 | 2 | 2-3 | 3 | 3 |

TABLE 3

| | Embodiments | | | | | | | Comparison Examples | | | |
|---|---|---|---|---|---|---|---|---|---|---|---|
| | 16 | 17 | 18 | 19 | 20 | 21 | 22 | 15 | 16 | 17 | 18 |
| Potassium dicyanoaurate (I) (g/L) | 1.5 | 1.5 | 1.5 | 1.5 | 1.5 | 1.5 | 1.5 | 1.5 | 1.5 | 1.5 | 1.5 |
| Potassium cyanide (mg/L) | 50 | 50 | 50 | 50 | 50 | 50 | 50 | 50 | 50 | 50 | 50 |
| Ethylenediaminetetramethylene phosphonic acid (g/L) | 150 | 150 | 150 | 150 | 150 | 150 | 150 | 150 | 150 | 150 | 150 |
| Potassium hydroxide (g/L) | 94.3 | 94.3 | 94.3 | 94.3 | 94.3 | 94.3 | 94.3 | 94.3 | 94.3 | 94.3 | 94.3 |
| Hydrazine(g/L) | 3.5 | 3.5 | 3.5 | 3.5 | 3.5 | 3.5 | 3.5 | | | | |
| Hydroxylamine sulfate (g/L) | | | | | | | | 1 | 1 | | |
| Hydroxylamine chloride (g/L) | | | | | | | | | | 1 | 1 |
| 48% aqueous solution of a chloride of sodium 1-benzyl-pyridinium-3-carboxylate (g/l) | 5 | 5 | 5 | 15 | 20 | 20 | 20 | 20 | 20 | 20 | 20 |
| pH | 5.0 | 6.5 | 7.0 | 6.5 | 6.0 | 6.5 | 6.7 | 6.0 | 6.5 | 6.0 | 6.5 |
| Gold deposition rate (μm/10 minutes) | 0.073 | 0.081 | 0.093 | 0.068 | 0.056 | 0.079 | 0.065 | 0.098 | 0.105 | 0.114 | 0.120 |
| Appearance of gold plating film | Good | Good | Good | Good | Good | Good | Good | Whit-ening | Whit-ening | Whit-ening | Whit-ening |
| Corrosion of nickel plating film | 2 | 2 | 2 | 2 | 2 | 1-2 | 2 | 5 | 5 | 5 | 5 |

Electroless gold plating solutions were prepared similar to Embodiment 1, except that the amount of 1-benzyl-pyridinium-3-carboxylic acid added, the base metal treatment agent, and the pH of the plating solution were as shown in Table 5. The solder bonding strength was evaluated by the following method, and the bath stability was also evaluated.

EXAMPLE 23

Solder Bonding Strength Test

A test piece on which an electroless gold plating film was formed was subjected to reflow processing three times with a preheat temperature of 170° C. and a reflow temperature of 240° C., and then a bowl mount was performed at the conditions shown in the following Table 4, and the solder bonding strength was measured. The test was performed using ten test pieces at each condition, and average value was calculated as the bonding strength. The results are shown in Table 5.

TABLE 4

| | |
|---|---|
| Pad diameter | 0.50 mm |
| Solder ball | Diameter 0.76 mm lead free solder (96.5% tin, 3% silver, 0.5% copper) |
| Pre-heat | 170° C. |
| Reflow | 240° C./30 seconds |
| Peak | 270° C. |
| Flux | Sparkle flux ES-1061 (product of Senju Metal Industry Co., Ltd.) |

TABLE 5

| Base metal surface treatment agent | Amount of 48% aqueous solution of a chloride of sodium 1-benzyl-pyridinium-3-carboxylate (g/L) | pH | Bonding strength average value N |
|---|---|---|---|
| Potassium formate | 5 | 6.3 | 23.0 |
| | | 6.5 | 21.8 |
| | | 6.7 | 17.6 |
| | 10 | 6.3 | 22.3 |
| | | 6.5 | 22.5 |
| | | 6.7 | 18.8 |
| | 20 | 6.3 | 24.4 |
| | | 6.5 | 21.8 |
| | | 6.7 | 22.6 |
| Hydrazine | 15 | 6.3 | 23.4 |
| | | 6.5 | 24.2 |
| | | 6.7 | 22.8 |
| | 20 | 6.3 | 23.9 |
| | | 6.5 | 23.9 |
| | | 6.7 | 24.0 |
| | 25 | 6.3 | 24.2 |
| | | 6.5 | 22.6 |
| | | 6.7 | 23.1 |

Bath Stability Test 100 mL of electroless gold plating solution was poured into a screw tube without a lid, heated to a liquid temperature of 90° C. using a water bath, and the time until the electroless gold plating solution separated under these conditions was measured in order to evaluate the stability of the bath.

EXAMPLE 24

An aqueous solution with a pH of 6.5 was prepared as an electroless gold plating solution by adding 1.5 g/L of potassium dicyanoaurate, 50 m g/L of potassium cyanide, 150 g/L of ethylenediaminetetramethylene phosphonic acid, 3.5 g/L of hydrazine, 20 g/L of a 48% aqueous solution of a chloride of sodium 1-benzyl-pyridinium-3-carboxylate, and 94.3 g/L of potassium hydroxide.

EXAMPLE 25

As electroless gold plating bath was prepared similar to the electroless gold plating bath of Embodiment 24, except that 20 g of potassium formate was used in place of the hydrazine. The stability test was performed on these plating solutions. The results are shown in Table 6.

As a conventional electroless gold plating solution, a plating solution that contained polyethyleneimine in place of the 1-benzyl-pyridinium-3-carboxylic acid (Aurolectroless (trademark) SMT-250 electroless gold plating solution, product of Rohm & Haas Electronic Materials Co. Ltd.) was subjected to a stability test as a comparative example. The results are shown in Table 6.

TABLE 6

| | Decomposition start time | Appearance |
|---|---|---|
| Embodiment 24 | 24 hours | black precipitate |
| Embodiment 25 | 28 hours | black precipitate |
| Comparative example 19 | 22 hours | decomposition |

EXAMPLE 26

Test of Polycarboxylic Acid Effectiveness

As an electroless gold plating solution, a plating solution was prepared by adding 56 g of tripotassium citrate to an aqueous solution of 1.5 g/L of potassium dicyanoaurate (I), 100 mg/L of potassium cyanide, 150 g/L of ethylenediaminetetramethylene phosphonic acid, 7 g of hydrazine, 20 g/L of 48% aqueous solution containing a chloride of sodium 1-benzyl-pyridinium-3-carboxylate, and 94.3 g/L of potassium hydroxide. The pH of the electroless gold plating solution was adjusted to 6.5 by adding additional potassium hydroxide. Using this electroless gold plating solution, a gold plating film was formed similar to Embodiment 1, and the various tests were performed as described above.

The gold plating solution which contained tripotassium citrate did not have a particularly noticeable difference for the deposition rate of the gold plating film, the appearance of the gold plating film, the solder bonding strength, and the bath stability, when compared with a gold plating solution which did not contain tripotassium citrate. However, when a gold plating solution which contains tripotassium citrate is used, pinhole-type corrosion of the nickel plating film is significantly reduced.

Test of the Effectiveness of a Pyridinium Carboxylate Compound Having a Phenyl Group or an Aralkyl Group at the First Position As an electroless gold plating solution, a 48% aqueous solution of a chloride of sodium 1-benzyl-pyridinium-3-carboxylate as shown in the following Table 6 was added to an aqueous solution where 2 g/L of potassium dicyanoaurate (I), 45 g/L of ethylenediaminetetraacetate and 67.5 g/L of tripotassium citrate were added to water, and the pH of the aqueous solution was adjusted using potassium hydroxide.

The test piece used in Embodiment 1 was immersed for 10 minutes in an electroless gold plating solution with a liquid temperature of 85° C. to form a gold plating film. The gold plating film that was formed was stripped using a gold plating-stripping solution Enstrip AU-78M (product of Meltex Inc.), and the presence of corrosion on the surface of the nickel which was the base metal was observed using an FE-SEM JSM-7000F (product of JEOL, Ltd.). The observation results are shown in Table 7 where 1=good, 2=fair good (minimal corrosion), 3=partially corroded, 4=fairly heavily corroded, and 5=heavy corrosion.

TABLE 7

| | Amount added | pH | Corrosion of nickel plating film |
|---|---|---|---|
| Comparative Example 20 | 0 | 5.5 | 5 |
| Embodiment 27 | 10 | 5.5 | 3 |
| Embodiment 28 | 20 | 5.5 | 3 |

TABLE 7-continued

| | Amount added | pH | Corrosion of nickel plating film |
|---|---|---|---|
| Embodiment 29 | 30 | 5.5 | 3 |
| Embodiment 30 | 40 | 5.5 | 3 |
| Embodiment 31 | 20 | 5.0 | 3 |

Pinhole-type corrosion of the nickel plating film was confirmed to be reduced by the addition of a chloride of sodium 1-benzyl-pyridinium-3-carboxylate to the electroless gold plating solution.

What is claimed is:

1. An electroless gold plating solution that is used to perform metal plating on the surface of a metal, comprising:

(i) a water soluble gold cyanide compound;

(ii) a complexing agent; and (iii) at least one pyridinium carboxylate compound having a phenyl group or an aralkyl group in the first position.

2. The electroless gold plating solution according to claim 1, further containing (iv) at least one compound selected from the group consisting of formic acid, salts of formic acid, hydrazine and derivatives of hydrazine, as a base metal surface treatment agent.

3. The electroless gold plating solution according to claim 2, wherein the base metal surface treatment agent is hydrazine or derivatives.

4. The electroless gold plating solution according to claim 1, wherein the complexing agent is at least one compound selected from the group consisting of ethylene diamine derivatives which have a phosphoric acid group or salt thereof or an aminocarboxylic acid group or salt thereof.

5. The electroless gold plating solution according to claim 1, wherein the pyridinium carboxylate compound having a phenyl group or an aralkyl group in the first position is one 1-phenylalkylene-pyridinium carboxylate compound.

6. The electroless gold plating solution according to claim 2, further containing (v) at least one compound selected from the group consisting of polycarboxylic acid and salts thereof.

7. An electroless gold plating solution that is used to perform gold plating on the surface of nickel or copper, comprising:

(i) a water soluble gold cyanide compound;

(ii) a complexing agent with at least one selected from the group consisting of ethylenediaminetetramethylene phosphonic acid or derivative thereof;

(iii) at least one pyridinium carboxylate compound having a phenyl group or an aralkyl group in the first position;

(iv) at least one compound selected from the group consisting of hydrazine and derivative thereof, as a base metal surface treatment agent; and (v) at least one compound selected from the group consisting of polycarboxylic acid and salts thereof.

8. The electroless gold plating solution according to claim 7, wherein the pyridinium carboxylate compound having a phenyl group or an aralkyl group in the first position is 1-benzyl-pyridinium-3-carboxylic acid or carboxylate thereof.

9. The plating solution according to either claim 7 or claim 8, wherein the pH of the electroless gold plating solution is between 5 and less than 7.

* * * * *